US006019263A

United States Patent [19]

Palmer

[11] Patent Number: 6,019,263

[45] Date of Patent: Feb. 1, 2000

[54] SMALL WATERCRAFT PORTAGE AND CARRYING DEVICE

[76] Inventor: Charles V. Palmer, 305 Day Dr., Ferguson, Mo. 63135-2253

[21] Appl. No.: 09/079,371

[22] Filed: May 15, 1998

Related U.S. Application Data

[63] Continuation-in-part of application No. 08/626,371, Apr. 2, 1996, abandoned.

[51] Int. Cl.[7] ..... A45F 3/10

[52] U.S. Cl. ..... 224/261; 224/185; 224/634; 114/343; 114/347

[58] Field of Search ..... 224/185, 261, 224/262, 263, 634; 114/347, 343

[56] References Cited

U.S. PATENT DOCUMENTS

| | | | |
|---|---|---|---|
| 3,734,367 | 5/1973 | Jackson | 224/262 |
| 4,018,370 | 4/1977 | Wood | 224/263 |
| 4,179,053 | 12/1979 | Figura | 224/634 |
| 4,214,685 | 7/1980 | Pletz | 224/634 |
| 5,161,722 | 11/1992 | Hembree | 224/148.2 |
| 5,183,194 | 2/1993 | Shirdavani | 224/636 |
| 5,299,524 | 4/1994 | Szilagyi | 114/347 |
| 5,547,246 | 8/1996 | Lambert | 224/262 |

*Primary Examiner*—Linda J. Sholl
*Attorney, Agent, or Firm*—Kevin L. Klug

[57] ABSTRACT

A small watercraft portage and carrying device particularly adapted for mounting onto an external backpack frame. The small watercraft portage and carrying device is able to carry various types of non-inflatable canoes, kayaks, and small boats. It places the weight of the watercraft or equipment onto the backpack frame, thereby distributing the weight onto the user at the points of backpack body attachment.

13 Claims, 9 Drawing Sheets

SMALL WATERCRAFT PORTAGE AND CARRYING DEVICE

This is a continuation-in-part of application Ser. No. 08/626,371, filed Apr. 2, 1996, now abandoned.

BACKGROUND OF THE INVENTION

The present invention relates in general to small watercraft portage and carrying devices and particularly to a small watercraft portage and carrying device which removably attaches to a conventional external frame backpack as commonly used by hikers, backpackers and explorers. The small watercraft portage and carrying device of this invention significantly improves the ability of the user to carry a canoe, kayak or small boat while wearing the backpack onto which it is attached.

As the art currently exists, conventional backpacks do not contain mechanical structures which allow the user to conveniently, reliably and securely carry a non-inflatable canoe, kayak or portable boat. A typical conventional external frame backpack frame is manufactured of a rigid and often metallic tubular material which extends above the head of the backpacker while in use. It generally has an exposed metallic tubular member orthogonal to the vertical axis of the backpack which is located above the head of the backpacker when the backpack is in use. The orthogonal member inhibits a user from positioning the gunnels or thwarts of a canoe, the cockpit coaming of a kayak, or the inside edges of a portable boat onto the shoulders of the user attempting to carry a small watercraft. Since many outdoor travelers often desire to carry a canoe, kayak or small boat while portaging among lakes, streams or rivers, it is unfortunate that conventional external frame backpacks create such an inconvenience for these persons. This inconvenience leads to an additional trip over a portage for transportation of said canoe, kayak or small boat.

The current method of canoe, kayak or small boat transport requires the user to overturn the canoe, kayak or small floatation device and place the center thwart of the canoe, the cockpit coaming of the kayak, or the gunnels of the portable boat onto the shoulders of the person carrying the device. The user will often attach a portage yoke to the center thwart of a canoe which in most cases has two pads that rest on top of the user's shoulders. Unfortunately, many modern canoes, kayaks and small boats are of such weight as to cause body fatigue or pose a risk of back and shoulder injury when transported in such a manner. The threat of exhaustion and physical injury can be greatly decreased if the weight of the canoe, kayak or small boat is born by the hips of the person carrying the weight. This is the form of support provided by an external frame backpack. Since many external frame backpacks permit weight bearing on the hips, any small watercraft portage and carrying device mounted onto such a pack would allow the canoe, kayak or small watercraft weight to be born mostly by the hips, thereby reducing fatigue or the risk of back and shoulder injury.

Accordingly, it is an object of the present invention to provide a small watercraft portage and carrying device for outdoor travelers which securely and removably installs onto a backpack frame and allows reliable transport of a non-inflatable canoe, kayak or small boat, over all types of terrain in a most efficient manner.

Another object of the present invention is to provide a small watercraft portage and carrying device which adds little additional weight to the backpack onto which it is mounted and which is installed quickly, with a minimum of effort, and with a minimum of specialty tools.

A further object of the present invention is to provide a small watercraft portage and carrying device which is structurally rigid and capable of supporting the weight of any canoe, kayak or small boat which is capable of transport by a single person or group of persons using such a device.

A still further object of the present invention is to provide a small watercraft portage and carrying device for users which is easily adjustable in width and angle such that any canoe, kayak or small boat may be carried.

A still further object of the present invention is to provide a small watercraft portage and carrying device for backpackers which is capable of manufacture as an integral original part of a backpack.

A final object of the present invention is to provide a small watercraft portage and carrying device for backpackers which is capable of easily adapting to carry a kayak.

SUMMARY OF THE INVENTION

To accomplish the foregoing and other objects of this invention there is provided a small watercraft portage and carrying device which allows users to carry a non-inflatable canoe, kayak or small boat using a conventional external frame backpack with the added benefit of placing a substantial amount of the weight of said canoe, kayak or small boat onto the hips of the user when the backpack is equipped with a conventional padded hip belt which is attached to the frame of said backpack.

In the embodiments described herein, the topmost exposed metallic tubular member which is orthogonal to the vertical axis of the backpack frame and typically contained on an external frame backpack and also located behind the head of the wearer is removed along with a portion of the uppermost section of left and right vertical tubing. The removed portion is replaced with the small watercraft portage and carrying device as further described. The orthogonal tubular member is typically removed by cutting each of the vertical sections of tubing holding it. Onto each of the remaining external frame tubing sections is mounted the necessary attaching hardware and fittings which hold a portage platform at the necessary height and angle.

The portage platform is a substantially flat surface which has a topmost exposed layer manufactured of a flexible rubber material, typically neoprene rubber, which presents a non-slip surface on which the interfacing structure of a canoe, kayak or small boat will easily grip. The portage platform is shaped with an arcuate form which when used is located behind the users head such that the user may easily move his or her head without forcible contact with the platform.

In the preferred embodiment, the portage platform mounting system comprises one or more first bottomside slots in the lower portion of the platform into which the remaining external frame tubing member ends are placed and rotatably secured. Further support is provided by two or more adjustable braces, each of which rotatably secure to the respective remaining external frame tubing members and also to another one or more second bottomside slots in the lower portion of the platform. In an alternative embodiment, the portage platform mounting system is easily installed by use of one or more threaded studs within one or more self holding tube inserts which are placed inside each of the cut and remaining external frame tubing member ends near the head of the user wearer. The mounting system must cant the portage platform to a level position relative to the ground such that the canoe, kayak or small boat is held securely and does not tip forward or backwards. The user controls the angle of the canoe, kayak or small boat with his or her hands to allow an ample field of vision in the direction of travel. All of the preferred and alternative embodiments incorporate the canting option.

The novelty of this invention is the combination of the existing external backpack frame with the mounting system and portage platform. The portage platform presents a rotatably adjustable base onto which a canoe, kayak or small boat will rest and by its own weight securely grip the portage platform topmost layer of non-slip material. Another alternative embodiment provides a pair of width adjustable foam collar assemblies for resting and holding the cockpit coaming of a kayak. An additional securing means, such as a hand hold apparatus, may also be used to help secure and control a kayak during transport. In this case the hand hold device is attached to the upper deck of the kayak prior to it being placed on top of the portage platform.

Both the preferred and alternative embodiments may utilize a number of different mounting methods which apply the clamping and securing action at different locations on the existing backpack frame structure.

The small watercraft portage and carrying device can be manufactured of many different materials, and also in different sizes, shapes and colors. In the preferred embodiment described herein, the small watercraft portage and carrying device comprises a portage platform of high strength moldable plastic material which is mounted and secured onto the aforementioned modified frame and two or more braces which are rotatably mounted onto the modified frame and the slots provide in the bottomside of the platform.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
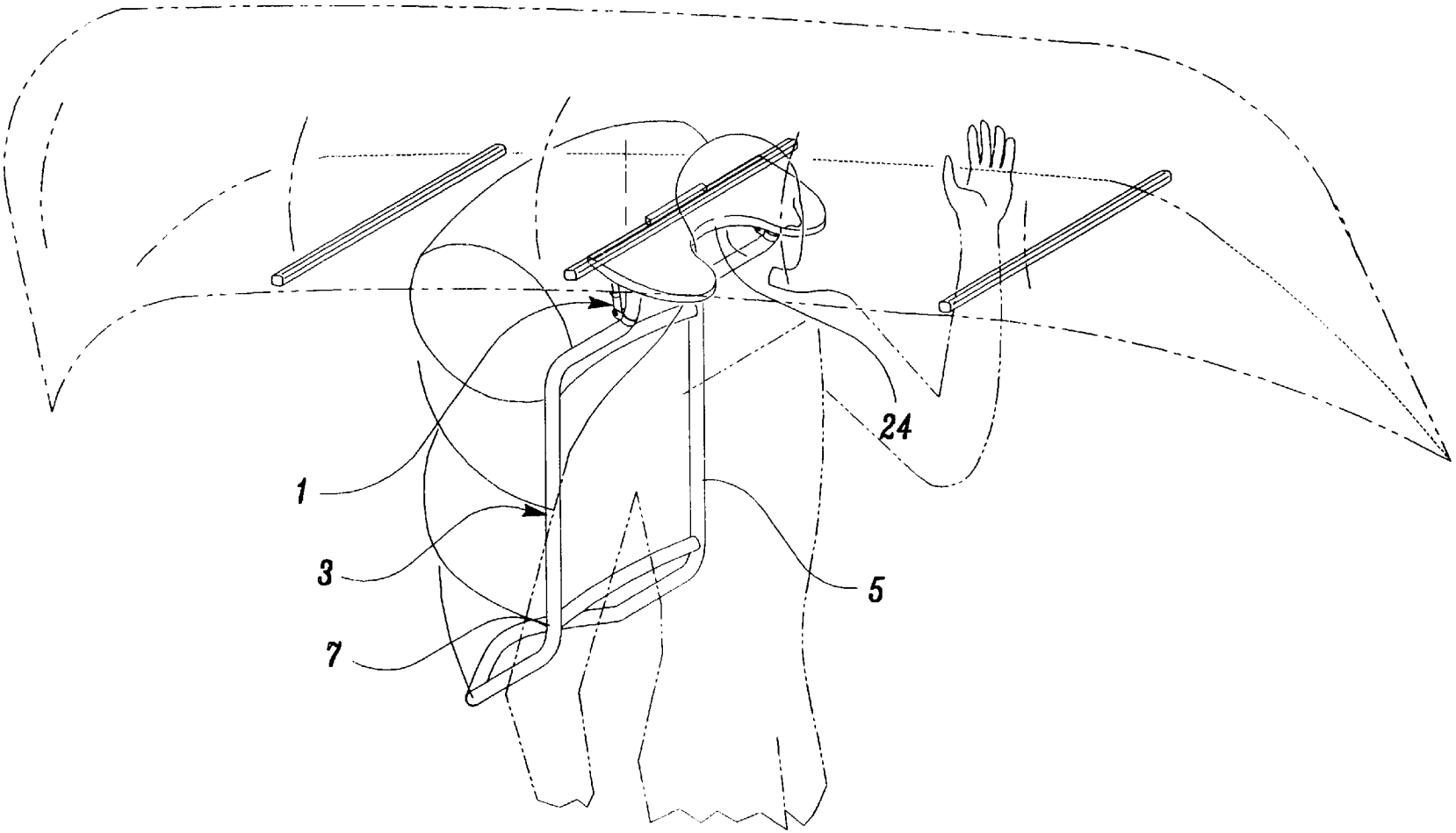
FIG. 1 is a perspective view of a preferred embodiment of the small watercraft portage and carrying device mounted onto a backpack on which is shown a canoe.
Figure 2:
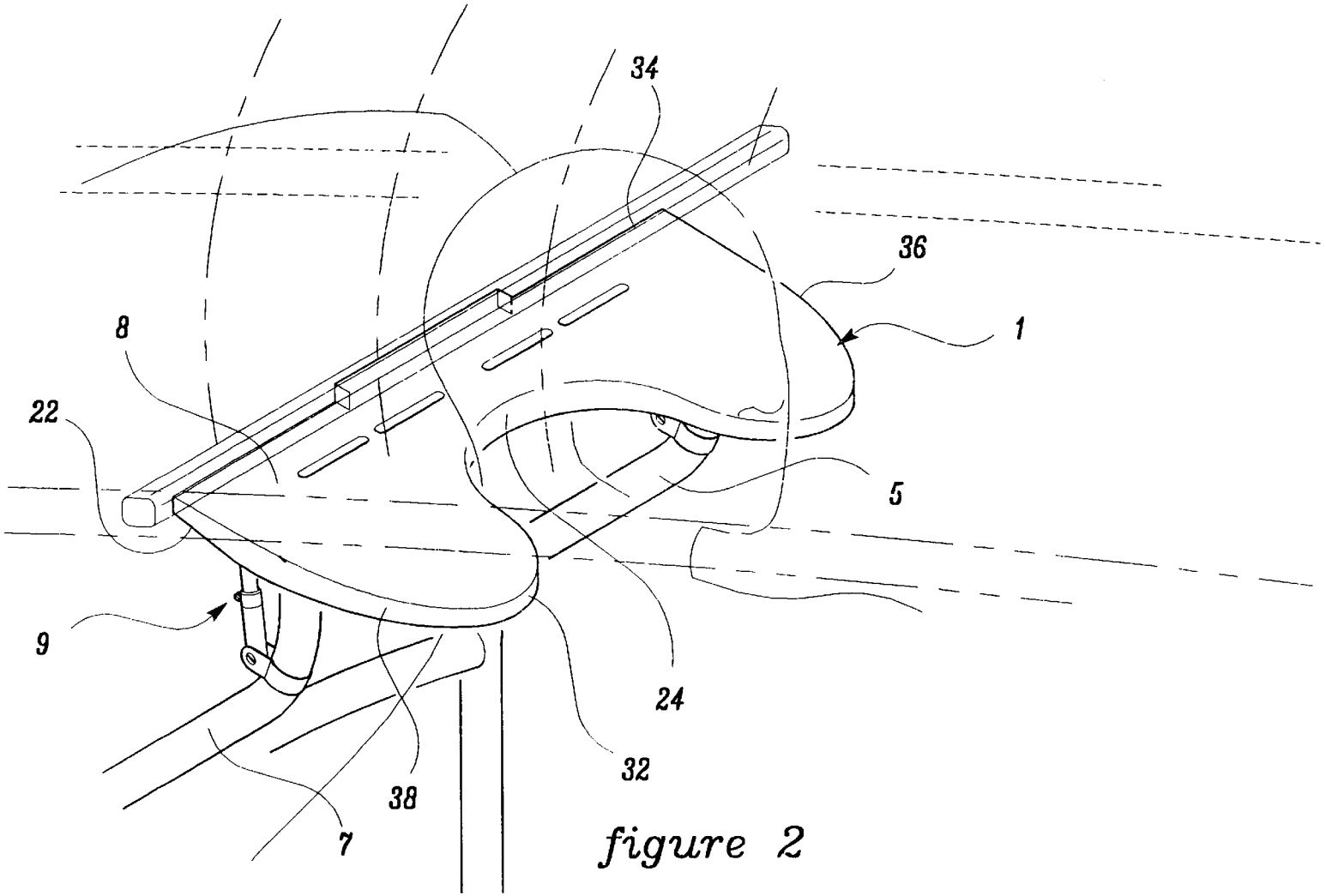
FIG. 2 is a detailed perspective view of a preferred embodiment of the small watercraft portage and carrying device.
Figure 3:
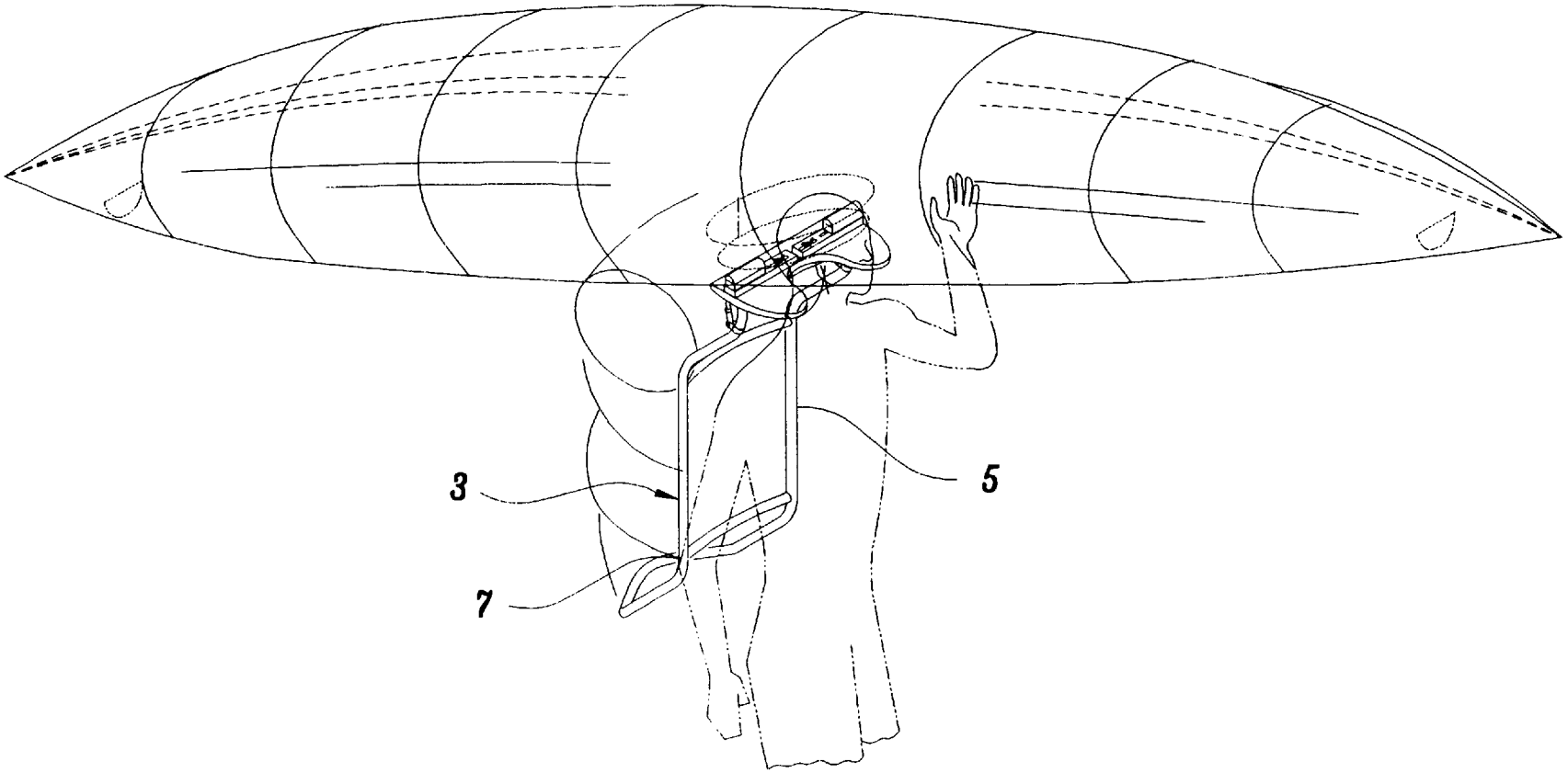
FIG. 3 is a perspective view of an alternative embodiment of the small watercraft portage and carrying device for kayak transportation where a pair of width adjustable foam collar assemblies are added to the portage platform.
Figure 4:
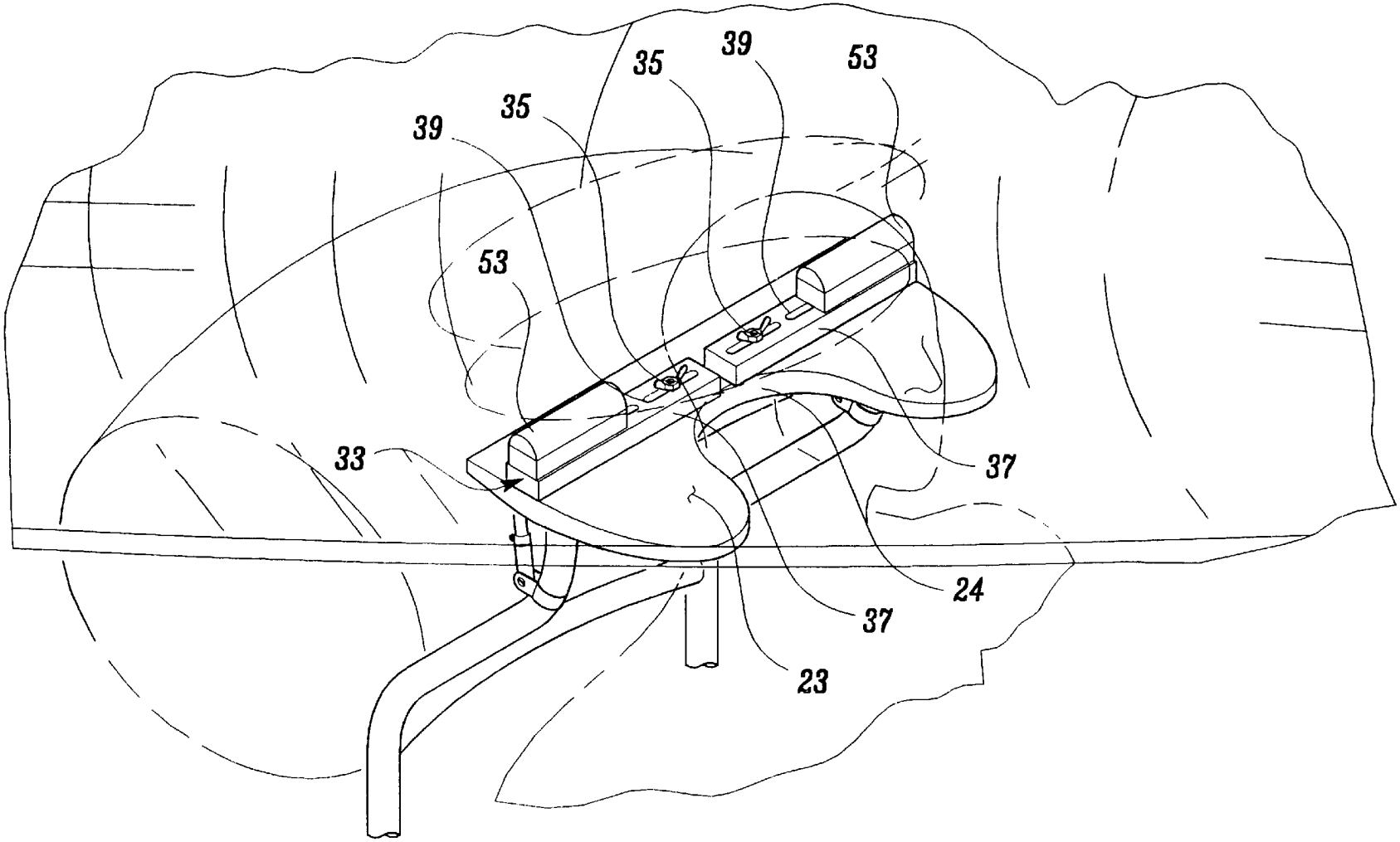
FIG. 4 is an detailed perspective view of an alternative embodiment of the small watercraft portage and carrying device for kayak transportation where a a pair of width adjustable foam collar assemblies are added to the portage platform.
Figure 5:
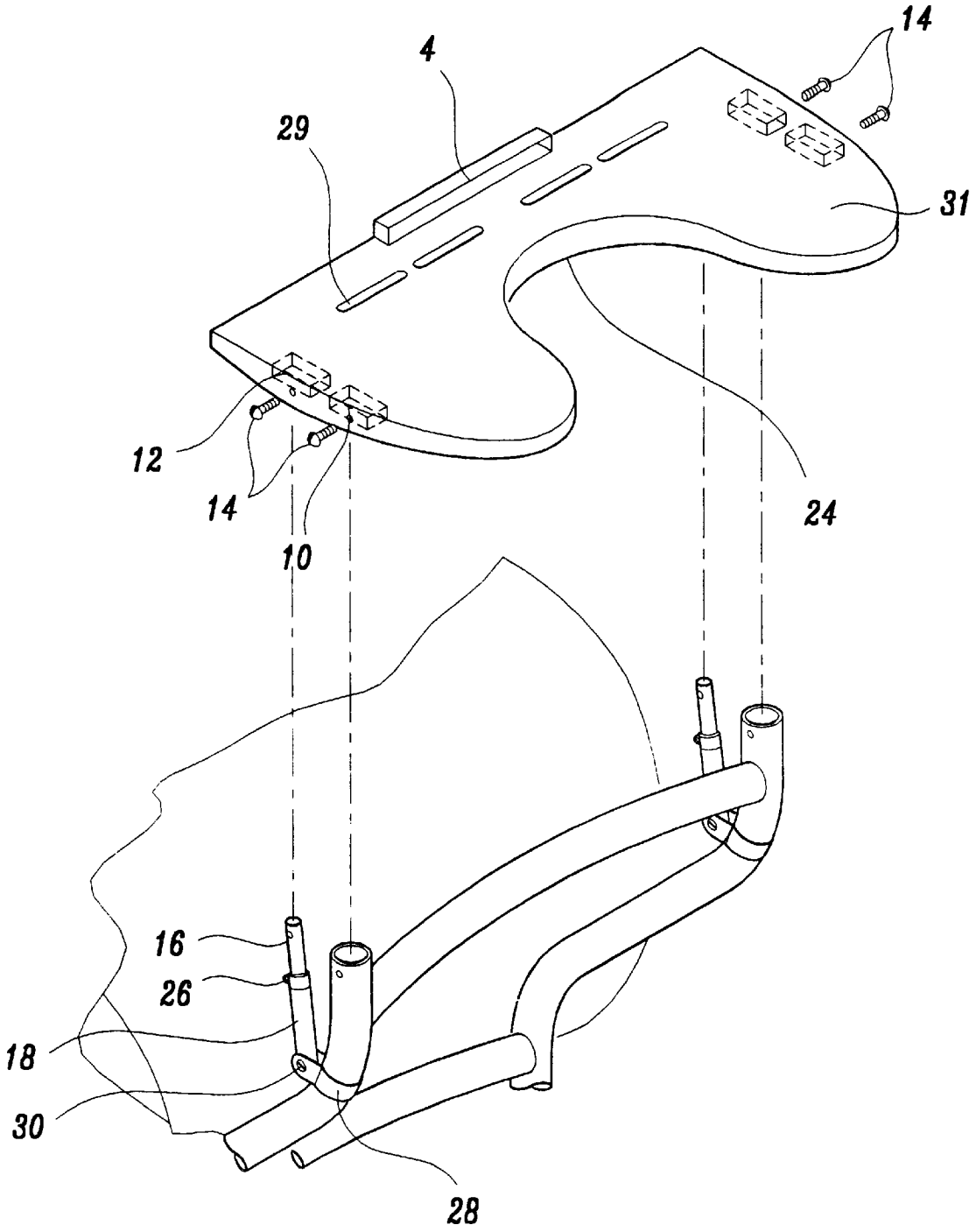
FIG. 5 is an exploded perspective view of a preferred embodiment of the small watercraft portage and carrying device showing the portage platform and associated hardware.
Figure 6:
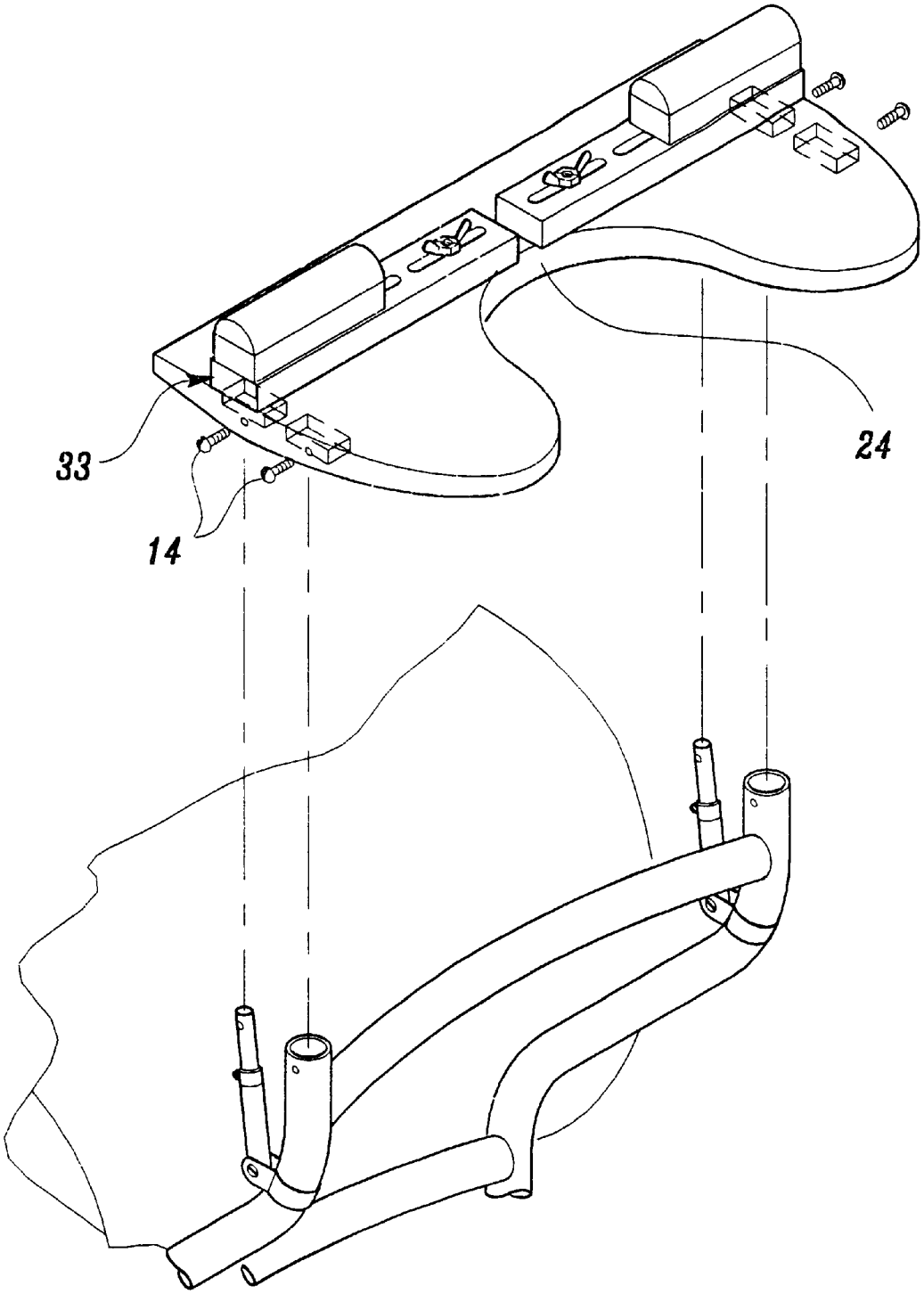
FIG. 6 is a partially exploded perspective view of an alternative embodiment of the portage platform providing a pair of width adjustable foam collar assemblies for kayak transportation.
Figure 7:
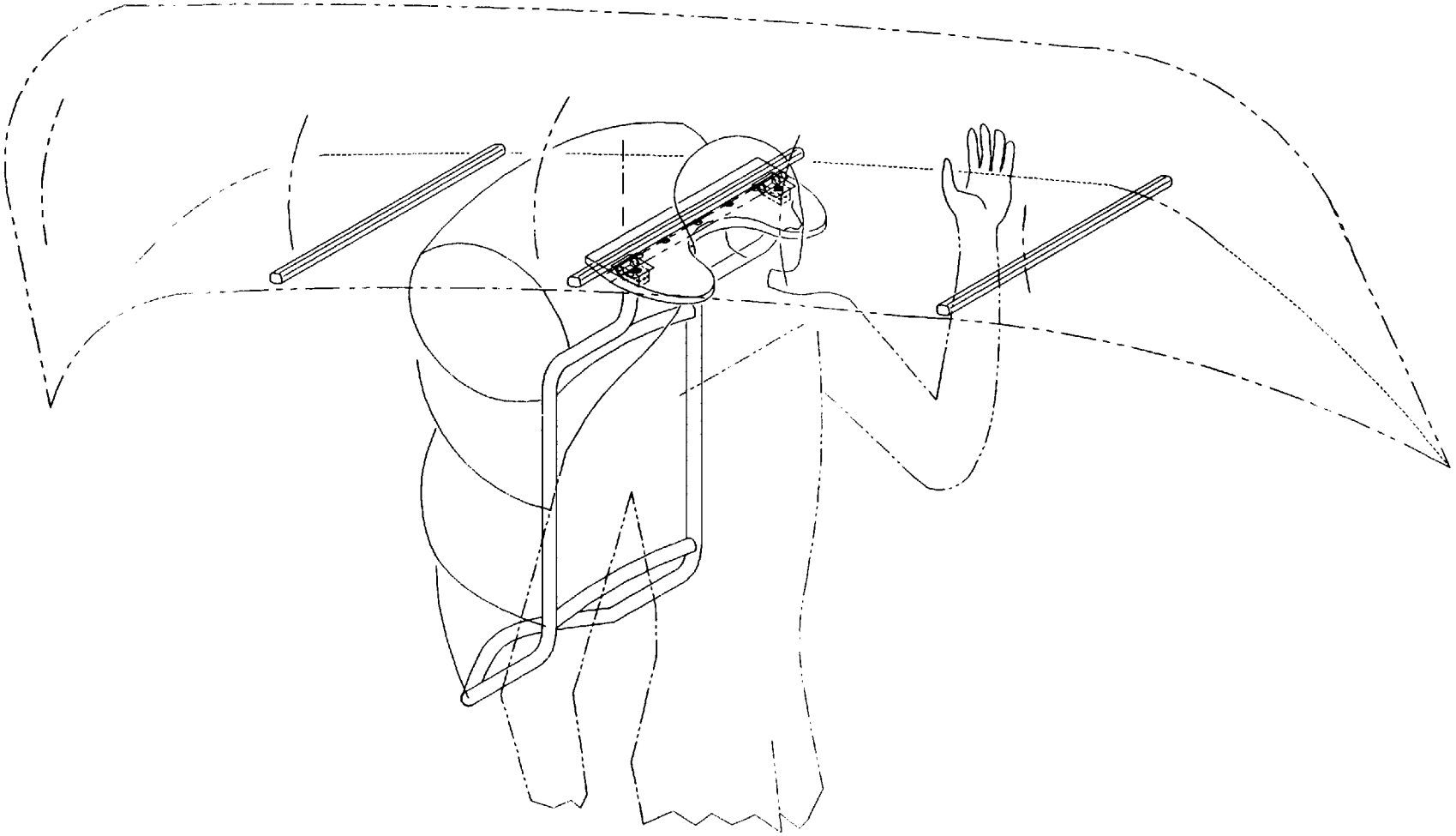
FIG. 7 is a perspective view of an alternative embodiment of the small watercraft portage and carrying device with a modified mounting system mounted onto an external frame backpack on which is shown a canoe.
Figure 8:
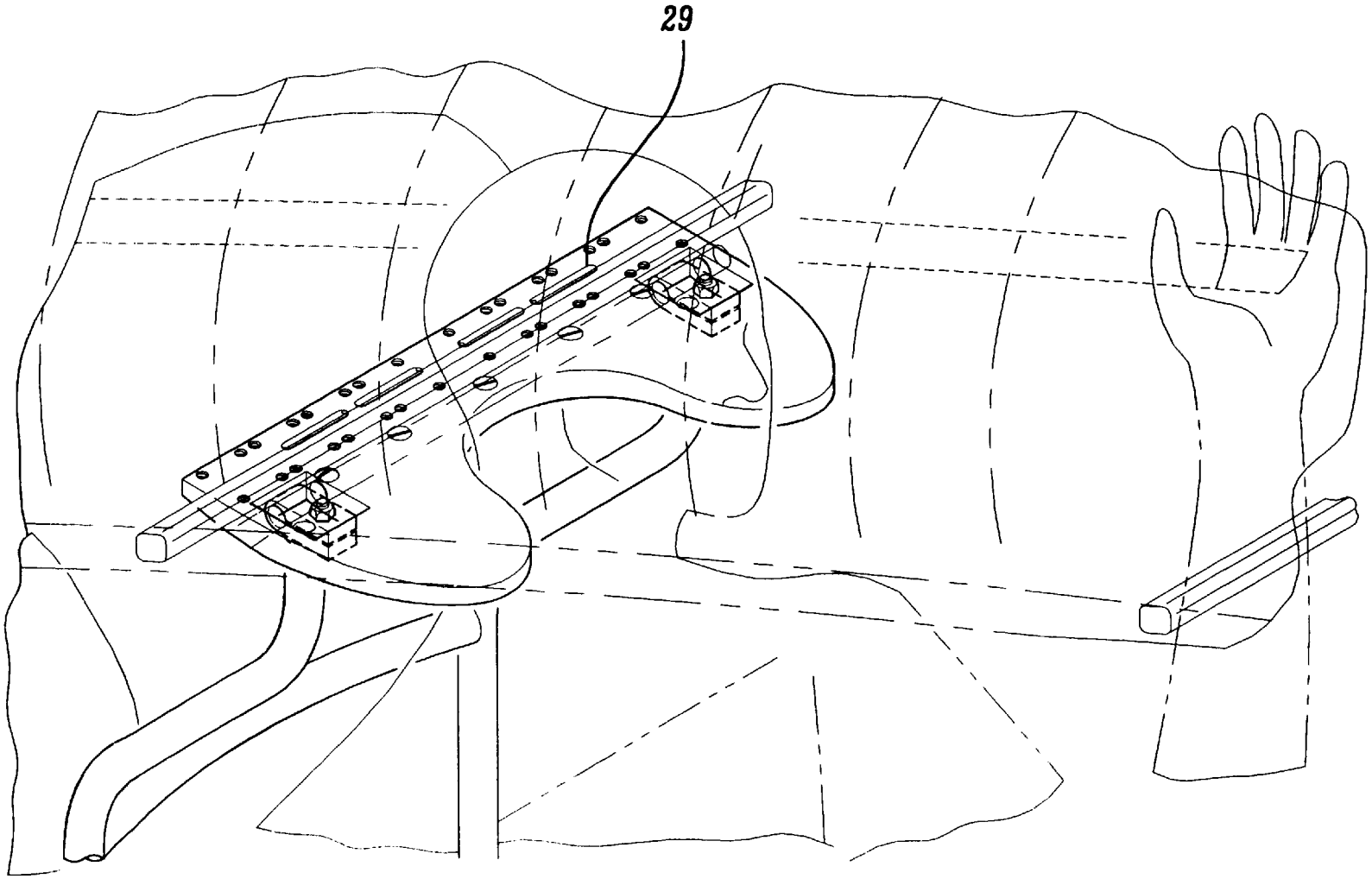
FIG. 8 is an detailed perspective view of an alternative embodiment of the small watercraft portage and carrying device with a modified mounting system.
Figure 9:
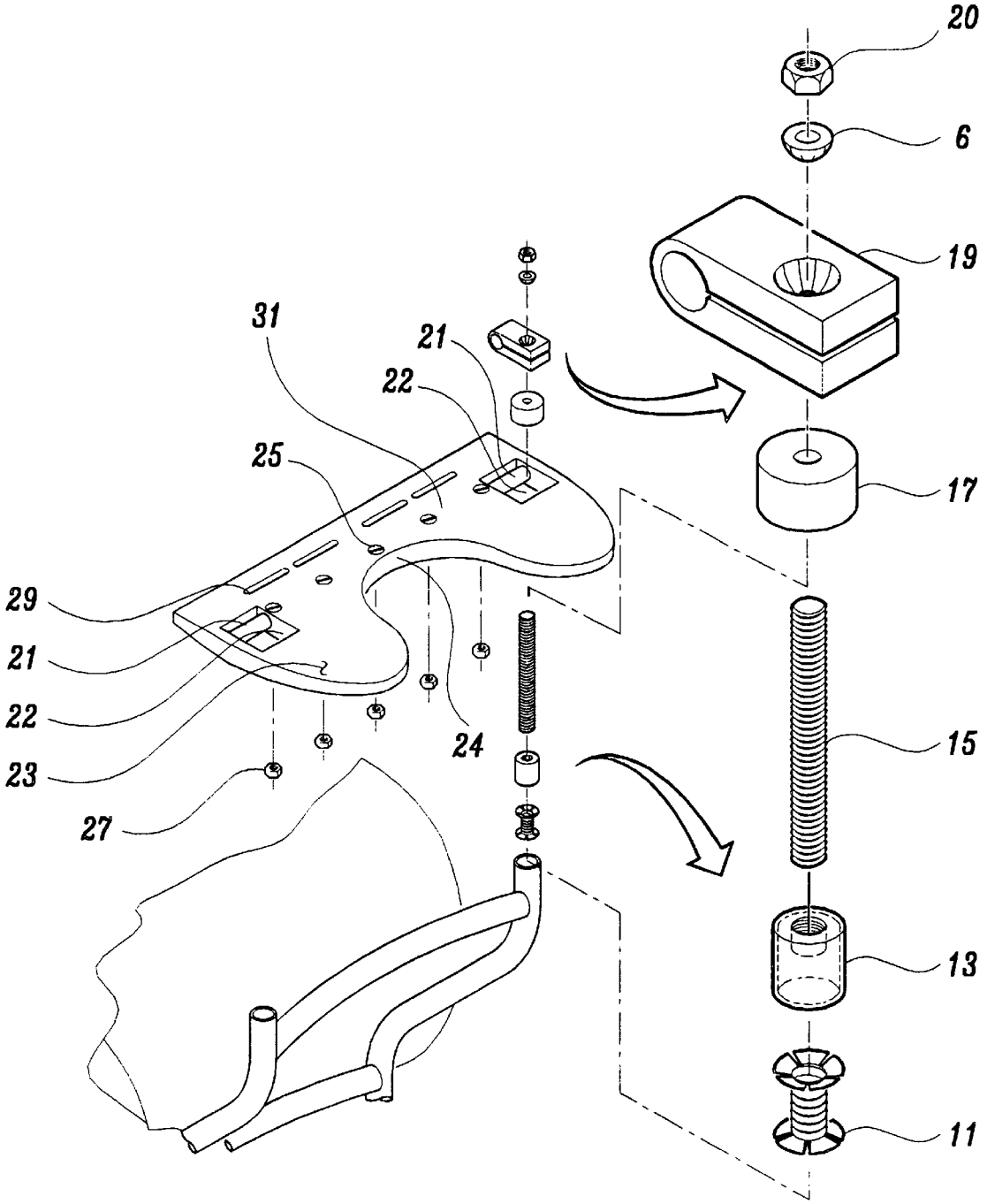
FIG. 9 is an exploded perspective view of an alternative embodiment of the small watercraft portage and carrying device with a modified mounting system.

Referring now to the drawings there is shown a preferred embodiment in FIGS. 1, 2 & 5 of the small watercraft portage and carrying device 1. The small watercraft portage and carrying device 1 is described connected to a conventional external frame backpack frame 3. A conventional external frame backpack frame 3 typically contains an aluminum alloy left vertical tube 5 and right vertical tube 7 which provides the vertical structural integrity of the conventional backpack frame 3. The right vertical tube 7 and the left vertical tube 5 typically are rigidly connected with a topmost orthogonal tubular member when manufactured. The topmost orthogonal tubular member is located at and behind or above head level when the backpack is used. Its location and shape inhibit the user from easily and securely carrying a canoe, kayak or small boat.

In order to install and use the small watercraft portage and carrying device 1, it is generally necessary to remove the topmost orthogonal tubular member. Removal is accomplished with simple tools such as a tubing cutter or hacksaw. The user simply cuts the left vertical tube 5 and the right vertical tube 7 below the topmost orthogonal tubular member. After completion of the cutting operation, the user installs the small watercraft portage and carrying device 1 onto the left vertical tube 5 and the right vertical tube 7.

A preferred embodiment of the small watercraft portage and carrying device 1 comprises a portage platform 23 and one or more adjustable braces 9 which connect between the vertical tubes 5, 7 and the platform 23. The portage platform 23 comprises a substantially flat platform having a a top side 8, a bottom side 22, a front edge 32, a rear edge 34, a left edge 36 and a right edge 38, said front edge 32 having a frontmost arcuate form 24, one or more first bottomside slots 10, and one or more second bottomside slots 12. Onto or near the rear edge 32 is mounted a rearmost lip 4 which helps to stabilize the small watercraft on the portage platform 23. Each of the bottomside slots 10,12 provide a mounting and securing location for the left vertical tube 5, the right vertical tube 7, and a first end of each of the one or more adjustable braces 9 respectively. The left vertical tube 5 and the right vertical tube 7 each mount into the one or more first bottomside slots 10 and the adjustable braces 9 each mount into the one or more second bottomside slots 12. Through each of the slots and the tubes 5, 7 or braces 9 which are located within said slots is placed a slot fastener 14, typically a screw, which rotatably attaches the tube 5, 7 or brace 9 to the portage platform 23. A substantially U-shaped clevis may operate as a substitute for the one or more first bottomside slots 10 and one or more second bottomside slots 12. In this form, each clevis would be mounted onto the bottomside of the portage platform 23 and serve as an alternative rotatable securing location for each of the tubes 5, 6 or braces 9 which are normally located within said slots 10, 12.

The adjustable brace 9 is comprised of a first brace member 16 on a first end, a second brace member 18 on a second end, a brace clamp 26 and a brace clevis support 28 of substantially "U" shape which attaches the adjustable brace 9 to a vertical tube 5,7. In a preferred embodiment, the first brace member 16 is formed from a tube which is of such a size that it is able to slide inside of the second brace member 18, a tube of different size than the first brace member 16, and be secured by the brace clamp 26. The brace clamp 26 constricts the second brace member 18 at the overlap of the two members 16, 18 to form a frictional hold between the first brace member 16 and the second brace member 18. The adjustment of the adjustable brace 9 is achieved by the sliding of the first brace member 16 within the second brace member 18, thereby providing for rotational adjustment movement of the portage platform 23 in an axis parallel with the direction of travel of the user. The adjustable brace 9 may also be comprised of other members which are not tubular in shape. This would include shapes such as rectangular or angular members which are slidably connected.

The brace clevis support 28 attaches to a vertical tube 5,7 via the constricting action provided by the brace clevis support screw 30. The brace clevis support screw 30 also rotatably holds the adjustable brace 9 via a hole near an end of the second brace member 18 of the adjustable brace 9. In alternative embodiments the brace clevis support 28 may have other attachment means such as clamps or pins which rotatably hold the adjustable brace 9 without the use of holes in the end of the adjustable brace 9.

An alternative embodiment of the small watercraft portage and carrying device 1 comprises a tube insert 11 and a closure cap 13 inserted into each left vertical tube 5 and right vertical tube 7 open end where previously cut. A threaded stud 15 is threaded through the closure cap 13, and threadedly engages the tube insert 11. The closure cap 13 is rotated until the tube insert 11, threaded stud 15 and the closure cap 13 achieve the necessary rigidity for further mounting of the small watercraft portage and carrying device 1 attaching hardware.

Onto each threaded stud 15 is typically mounted a spacer 17. The length of the spacer 17 is determined by the needs of the backpacker and the layout of the backpack frame 3 onto which the small watercraft portage and carrying device 1 is attached. After installation of each spacer 17, a tube clamp 19 is placed over each threaded stud 15 and seated onto each spacer 17 with the force provided by a spherical washer 6 and tube clamp nut 20 which threadedly engages the threaded stud 15. Each tube clamp 19 engages an internal tube 21 securely mounted within a portage platform 23. The portage platform is of substantially flat shape with an arcuate frontmost form 24 for placement of the user's head. Engagement of the internal tube 21 by each tube clamp 19 is achieved by providing at least one platform cutout 22 by which a section of the internal tube 21 is completely exposed and uncovered. Typically, the internal tube 21 is securely mounted to the portage platform 23 via one or more platform attaching bolts 25. The platform attaching bolts 25 are placed through the portage platform 23 and the internal tube 21 and threadedly engaged with platform attaching nuts 27 thereby securing the internal tube 21 to the portage platform 23 and as result securely mounting the portage platform 23 to the backpack frame 3. Until each tube clamp nut 19 is fully tightened, the portage platform 23 is capable of rotational movement about the engaging tube clamp 19 clamping axis. This allows portage platform 23 adjustment to suit the user's needs by providing a stable support for his/her watercraft.

The portage platform 23 may be manufactured in a variety of shapes such that the user's head movement is unencumbered. It may be manufactured of a variety of materials but is typically manufactured of injection molded fiber reinforced high strength plastic. In an alternative embodiment, it also contains one or more platform slots 29, from the top side 8 to the bottom side 22 of the platform 23, by which specialty attachments, such as a pair of width adjustable foam collar assemblies 33, may be secured for a kayak or small boat. The topmost surface of the portage platform 23 may be coated with a thin platform non-slip surface 31, typically neoprene rubber. The platform non-slip surface 31 provides a bearing surface for the interfacing structure of a canoe or small boat thereby minimizing movement of the small watercraft due to sudden and unexpected movements by the user as he/she walks across a portage.

For non-inflatable kayak transportation and some non-inflatable small boats, the alternative embodiment incorporates one or more foam collar assemblies 33 which are typically mounted onto the portage platform 23 and secured via assembly attaching bolts 35 through the platform slots 29. The foam collar assembly 33 comprises a mounting base 37, each with one or more base slots 39 through which the assembly attaching bolts 35 are placed, and a topmost non-slip pad 53. The topmost non-slip pad 53 is preferably attached to the mounting base 37 with a waterproof adhesive but may also be attached with conventional fasteners such as screws, pins, rivets, etc. The one or more base slots 39 along with the platform slots 29 allow for width adjustment of the foam collar assemblies 33 in order to accommodate and rest upon the cockpit coming of a non-inflatable kayak. The topmost non-slip pad 53 may be manufactured from a variety of materials but is typically manufactured of a rigid light weight closed cell foam material such as Ethafoam™. The friction created by the weight of the small watercraft on the topmost non-slip pad 53 securely holds the small watercraft to the small watercraft portage and carrying device 1.

In operation of a preferred embodiment, the user installs the small watercraft portage and carrying device 1 onto the backpack frame 3 as previously described. Before tightening the the brace clamp 26, the backpacker adjusts the portage platform 23 angle by sliding the first brace member 16 into or out of the second brace member 18. This adjustment is intended to level the portage platform and provide a secure bearing surface angle for the interfacing support structure of the canoe, kayak or small boat. Upon completion of the adjustment, the backpacker tightens the brace clamps 26 in order to hold the desired angle of the portage platform 23.

Should the backpacker desire to carry a non-inflatable kayak with the preferred embodiment, he or she would mount the one or more foam collar assemblies 33 with the assembly attaching bolts 35 through the platform slots 29 which would be formed into the portage platform 23. The width of the foam collar assemblies 33 would then be adjusted to the width required for the kayak coaming. Upon achievement of the proper width, the assembly attaching bolts 35 are tightened in order to secure the foam collar assemblies 33 to the portage platform 23.

In operation of an alternative embodiment, the user installs the small watercraft portage and carrying device 1 onto the backpack frame 3 as previously described. Before tightening the tube clamp 19 by rotating the tube clamp nut 20, the backpacker adjusts the portage platform 23 angle by rotation about the tube clamp 19 clamping axis. This adjustment is intended to level the portage platform and provide a secure bearing surface for the interfacing support structure of the canoe, kayak or small boat. Upon completion of the adjustment, the backpacker tightens the tube clamp nut 20 and then mounts a small watercraft directly onto the portage platform 23.

After mounting the center thwart or gunnels of a canoe, the cockpit coaming of a kayak, or the gunnels of a small boat onto the portage platform 23 of any embodiment, the user physically holds onto the small watercraft to provide the necessary stabilization in order to begin his or her portage or carrying. To assist transport of a kayak, the user may also attach a handhold apparatus, consisting of an elongated rod, to his/her kayak or small boat to help secure the watercraft while portaging. The handhold apparatus eliminates much of the physical exertion necessary to stabilize the small watercraft on the portage platform.

Should the user require additional height or width adjustment with an alternative embodiment, which is especially useful when transporting a kayak, he or she will attach the foam collar assemblies 33 onto the portage platform 23 with the assembly attaching bolts 35 and adjust the width as allowed by the platform slots 29 which are formed into the portage platform 23. After proper adjustment, the user will tighten the assembly attaching bolts 35 in order to secure the foam collar assemblies 33. Upon attachment of the foam collar assemblies 33 a kayak or a small boat may be mounted onto and frictionally contact the topmost non-slip pads 53 of the foam collar assemblies 33, thereby allowing the small watercraft portage and carrying device 1 to portage or carry a kayak.

From the foregoing description, those skilled in the art will appreciate that all objects of the present invention are realized. Preferred and alternative embodiments of a small watercraft portage and carrying device have been shown and described. Each rotatably attach to a backpack frame and allow for the transport of a canoe, kayak or small boat. The small watercraft portage and carrying device also allows for the carrying of other equipment or goods on its platform or hooks. Furthermore, the device of this invention is convenient and easy to use. The preferred design of the present invention, as well as alterations that will now be apparent to those skilled in the art, all allow use of the device with a conventional external frame backpack. The preferred and alternative embodiments of the present invention are available in a variety of shapes and sizes.

Having described the invention in detail, those skilled in the art will appreciate that modifications may be made of the invention and its method of attachment to a conventional backpack frame without departing from its spirit. Therefore, it is not intended that the scope of the invention be limited to the specific embodiments illustrated and described, rather, it is intended that the scope of this invention be determined by the appended claims and their equivalents.

What is claimed is:

1. A small watercraft portage and carrying device for substantially easing transport of small noninflatable watercraft and capable of mounting upon a external frame backpack frame having a left and right vertical tube, when said frame is used by a backpacker user, comprising:

a portage platform having a top side, a bottom side, a front edge, a rear edge, a left edge and a right edge, said front edge having a frontmost arcuate form, said right edge and said left edge of sufficient length to separate said front edge and said rear edge, thereby allowing said top side to contain sufficient area to form a bearing surface onto which said watercraft may be placed; and means for rotatably attaching said bottom side of said portage platform to said left and right vertical tube of said external frame backpack whereby said portage platform frontmost arcuate form is substantially near, yet not above, a head of said backpacker user head, whereby said right edge is on the right of said backpacker user's head and said left edge is on the left side of said backpacker user's head and said frontmost arcuate form of said front edge of said portage platform is proximately located near a rear portion of said backpacker user's head, and said top side is at or below the top of said backpacker user's head; and said frontmost arcuate form of said portage platform shaped to substantially avoid contact with said backpacker user's head; and said means for rotatably attaching said portage platform enabling canting movement of said portage platform in a forward and rearward direction of travel of a said backpacker user.

2. A small watercraft portage and carrying device as defined in claim 1 further comprising:

a platform non-slip surface mounted onto said top side of said portage platform; and a rearmost lip mounted proximately near said rear edge of said platform and substantially perpendicular with said bearing surface of said platform.

3. A small watercraft portage and carrying device as defined in claim 1, said means for rotatably attaching said bottom side of said portage platform to a backpack frame comprising:

one or more first bottomside slots, one or more second bottomside slots, one or more adjustable braces having a first end and a second end which are each moveable relative to the other, and a means for attaching said one or more adjustable braces to said vertical tubes of said external frame backpack;

said left and right vertical tubes rotatably mounted within said one or more first bottomside slots; and said first end of said one or more adjustable braces rotatably mounted within said one or more second bottomside slots; and said second end of said one or more adjustable braces rotatably mounted within said means for attaching said one or more adjustable braces; and said means for attaching said one or more adjustable braces to said vertical tubes mounted onto said vertical tubes;

whereby said relative movement of said first end of said adjustable brace relative to said second end of said adjustable brace provides for canting of said portage platform in the direction of travel of said user.

4. A small watercraft portage and carrying device as defined in claim 3, said means for attaching said one or more adjustable braces to said vertical tubes of said external frame backpack comprising:

one or more brace clevis supports constrictingly attached to said vertical tubes;

said brace clevis support comprising a substantially U-shape member; and one or more brace clevis support screws through said substantially U-shaped member; and a hole in said second end of said adjustable brace whereby said brace clevis support screw may rotatably hold said second end of said adjustable brace and constrict said substantially U-shaped member in order to provide the constriction necessary to constrictingly attach said substantially U-shaped member to said vertical tube.

5. A small watercraft portage and carrying device as defined in claim 4, said adjustable brace comprising:

a first brace member of tubular shape, a second brace member of tubular shape and a brace clamp;

said first brace member of sufficient size to slide inside of said tubular shape of said second brace member to form an overlapping portion; and said brace clamp mounted onto said overlapping portion of said brace members whereby said second brace member is constrictingly held onto said first brace member with the constricting action of said brace clamp.

6. A small watercraft portage and carrying device as defined in claim 1, said means for rotatably attaching said bottom side of said portage platform to a to a left and right vertical tube of said external frame backpack comprising:

an internal tube mounted from said left edge to said right edge of said portage platform, at least one platform cutout interdisposed from said top side to said bottom side of said portage platform whereby a section of said internal tube is completely exposed, one or more tube clamps mounted onto said internal tube through said platform cutout, a fastening means for rigidly attaching said tube clamp to said backpack frame.

7. A small watercraft portage and carrying device as defined in claim 6, said fastening means for rigidly attaching said tube clamp to said backpack frame comprising:

one or more tube inserts first inserted into one or more vertical tubes of said backpack frame, one or more closure caps mounted onto said one or more vertical tubes, one or more threaded studs threadedly engaging said one or more tube inserts and said one or more closure caps, thereby securing said threaded studs to said one or more vertical tubes, said one or more tube clamps mounted onto said threaded studs.

8. A small watercraft portage and carrying device as defined in claim 1 said portage platform further comprising:

one or more foam collar assemblies; and an adjustable mounting means for said foam collar assemblies on said top side of said portage platform; and said foam collar assemblies having a topmost non-slip pad whereby the cockpit coaming of a kayak may be frictionally held when said foam collar assemblies are adjusted to match the width of the kayak coaming.

9. A small watercraft portage and carrying device as defined in claim 8 said adjustable mounting means comprising:

one or more platform slots from said top side to said bottom side of said platform; and one or more assembly attaching bolts through said foam collar assembly and said platform slot, whereby said one or more foam collar assemblies are moveable until said assembly attaching bolts are tightened.

10. A method for a backpacker user to carry a canoe, kayak, or small boat with a external frame backpack frame having a left and right vertical tube comprising:

rotatably attaching a portage platform proximately near a topmost portion of an external frame backpack frame but below the topmost portion of a head of said backpacker user head and onto said backpack frame such that said portage platform does not appreciably interfere with said backpacker user's head, said portage platform having a top side, a bottom side, a front edge, a rear edge, a left edge and a right edge and sufficient surface area to form a bearing surface with said canoe, kayak, or small boat; and forming a substantially arcuate form on said front edge; and mounting a rearmost lip near said rear edge; and mounting said external frame backpack onto said backpacker user; and placing the canoe, kayak, or small boat onto said portage platform; and holding said canoe, kayak, or small boat, to provide proper balance and allow adequate field of vision for said backpacker user; and said backpack user walking.

11. The method as defined in claim 10, said method for rotatably attaching a portage platform further comprising:

providing an internal tube mounted from said left edge to said right edge of said portage platform, providing at least one platform cutout interdisposed from said top side to said bottom side of said portage platform whereby a section of said internal tube is completely exposed, providing one or more tube clamps mounted onto said internal tube through said one or more platform cutouts, providing a fastening means for rigidly attaching said one or more tube clamps to said backpack frame.

12. The method as defined in claim 10, the method for rotatably attaching a portage platform further comprising:

forming one or more first bottomside slots and one or more second bottomside slots into the bottom side of said platform; and attaching rotatably one or more adjustable braces having a first end and a second end, said ends are each moveable relative to the other, between said second bottomside slots and said external frame backpack; and mounting said topmost portion of said external frame backpack rotatably within said first bottomside slots, whereby said adjustable brace allows said portage platform to cant relative to the direction of movement of said user.

13. The method as defined in claim 10, the further method of providing for the transport of a kayak comprising:

forming one or more foam collar assemblies having a topmost non-slip pad; and adjustably mounting said foam collar assemblies on said top side of said portage platform; and adjusting said foam collar assemblies to fit a cockpit coaming of said kayak whereby the cockpit coaming of said kayak may be frictionally held.

* * * * *